US006427565B1

(12) United States Patent
Ping

(10) Patent No.: US 6,427,565 B1
(45) Date of Patent: Aug. 6, 2002

(54) PARALLEL GRIP PLIER

(75) Inventor: Qiu Jian Ping, Hangzhou (CN)

(73) Assignee: Great Neck Saw Manufacturers, Inc., Mineola, NY (US)

( * ) Notice: Subject to any disclaimer, the term of this patent is extended or adjusted under 35 U.S.C. 154(b) by 0 days.

(21) Appl. No.: 09/712,485

(22) Filed: Nov. 14, 2000

(51) Int. Cl.[7] ..... B25B 7/12
(52) U.S. Cl. ..... 81/362; 81/352
(58) Field of Search ..... 81/352, 362

(56) References Cited

U.S. PATENT DOCUMENTS

| | | | | |
|---|---|---|---|---|
| 297,640 A | | 4/1884 | Schmemann | |
| 682,701 A | * | 9/1901 | Howland | 81/352 X |
| 793,200 A | | 6/1905 | Knight | |
| 1,653,861 A | | 12/1927 | Leonard | |
| 2,765,688 A | | 10/1956 | Evans | |
| 3,101,017 A | | 8/1963 | Malkin et al. | |
| 3,157,075 A | | 11/1964 | Filia | |
| 3,200,675 A | | 8/1965 | Willis | |
| 4,283,933 A | | 8/1981 | Wiener | |
| 4,381,661 A | | 5/1983 | Wiener et al. | |
| 4,403,497 A | | 9/1983 | Matteucci | |
| 4,433,569 A | | 2/1984 | Santinelli | |
| 4,602,535 A | | 7/1986 | Wiener et al. | |
| 4,825,735 A | | 5/1989 | Undin | |
| 4,982,630 A | * | 1/1991 | Schmode et al. | 81/352 |
| D349,636 S | | 8/1994 | White et al. | |

* cited by examiner

*Primary Examiner*—James G. Smith
(74) *Attorney, Agent, or Firm*—Joseph J. Previto

(57) ABSTRACT

A plier comprising a first handle member and a second handle member, each of said handle member having a jaw portion, an intermediate portion and a hand grip portion, the second handle member comprises a movable hand grip portion and a movable jaw portion and the first handle member comprises a stationary jaw portion and a stationary hand grip portion with the movable jaw portion and the movable hand grip portion being separate from each other. The moveable jaw portion having a tail pivotally mounted to the intermediate portion of the moveable second handle member. The intermediate portion of the second handle member being pivoted to the intermediate portion of the first handle member. A linkage having one end pivotally attached to the tail and its other end being pivotally attached to the intermediate portion of the first handle member.

9 Claims, 4 Drawing Sheets

PARALLEL GRIP PLIER

BACKGROUND

The present invention relates to pliers and more particularly to an improved parallel grip plier.

Parallel grip pliers are adapted to move a pair of jaws closer to each other in a path which is generally at right angles to the jaw teeth so that the jaws remain parallel to each other as they move toward and away from each other. This permits the jaws to firmly and positively grip articles between them. A number of these parallel grip pliers have been designed with a variety of operating mechanisms. Some of these mechanisms are complicated to assemble, expensive to manufacture and difficult to use.

OBJECTS

The present invention overcomes these disadvantages and has for one of its objects the provision of an improved parallel grip plier which is simple to use.

Another object of the present invention is the provision of an improved parallel grip plier which is inexpensive to manufacture.

Another object of the present invention is the provision of an improved parallel grip plier which is easily assembled.

Other and further objects will be obvious upon the understanding of the illustrative embodiment about to be described, or which will be indicated in the appended claims, and various advantages not referred to herein, will occur to one skilled in the art upon employment of the invention in practice.

DRAWINGS

A preferred embodiment of the invention has been chosen for the purposed of illustration and description and is shown in the accompanying drawings forming a part of the specification wherein:

FIG. 1. is an exploded perspective view showing the parallel grip plier of the present invention.

DESCRIPTION

Figure 1:
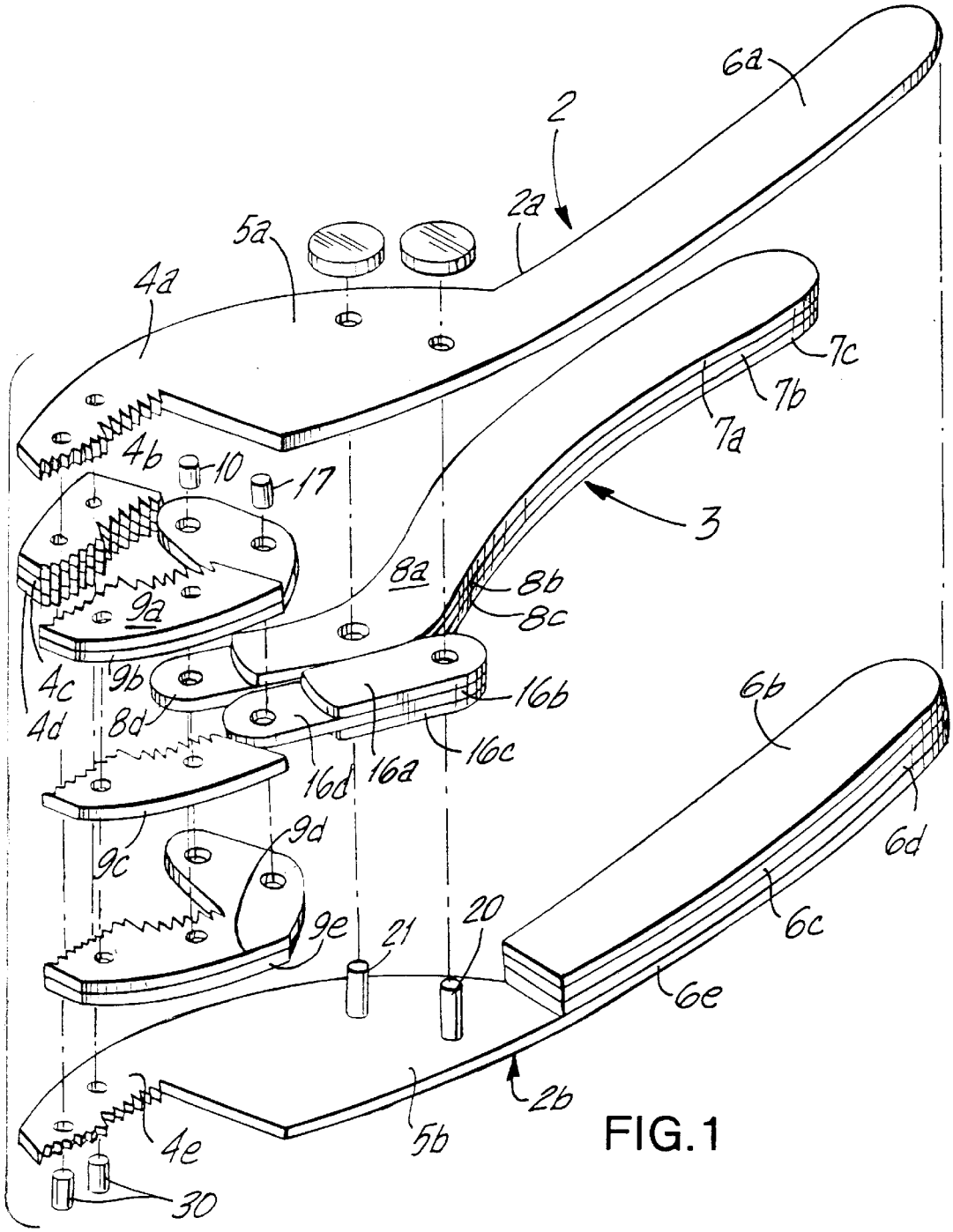

Referring to the drawings, the parallel grip plier 1 of the present invention comprises a first handle member 2 and a second handle member 3. The first handle member 2 comprises a stationary jaw portion 4, an intermediate portion 5 and a hand grip portion 6. The second handle member 3 comprises a movable hand grip portion 7, and intermediate portion 8 and a movable jaw portion 9.

Figure 4:
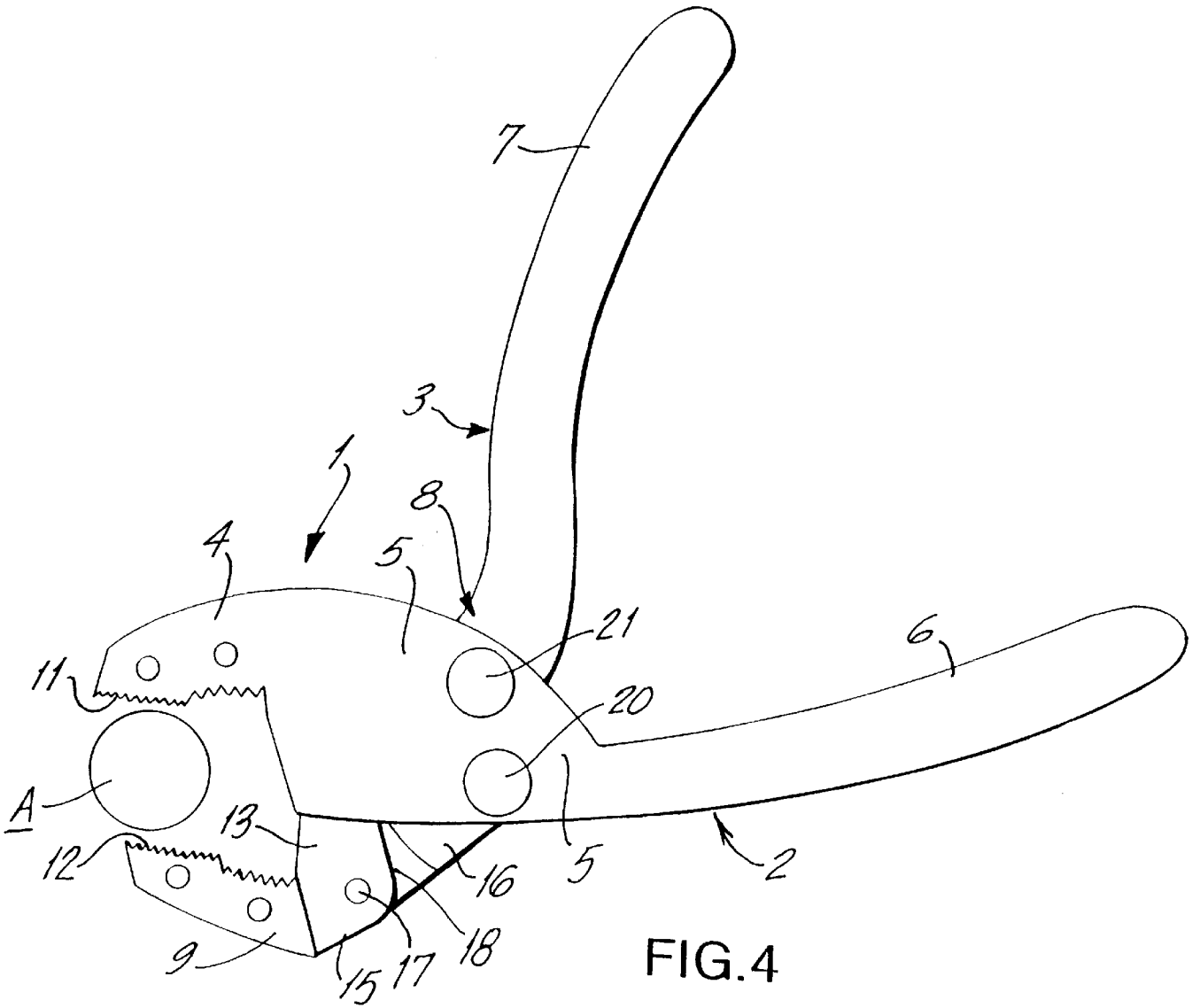
FIG. 4 is a side elevational view showing the tool in its open position.
Figure 5:
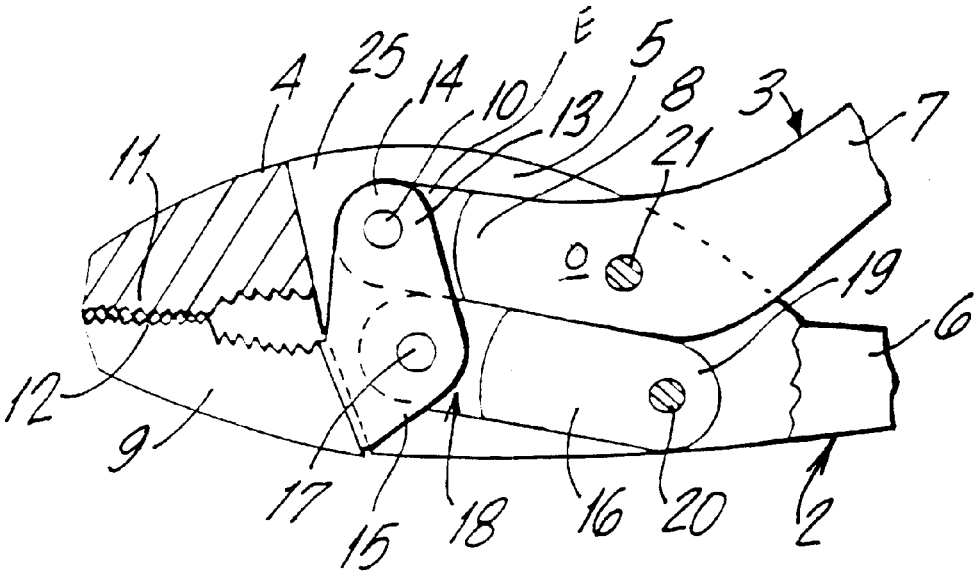
FIG. 5 is a detail partly in section showing the jaws in their closed position.
Figure 6:
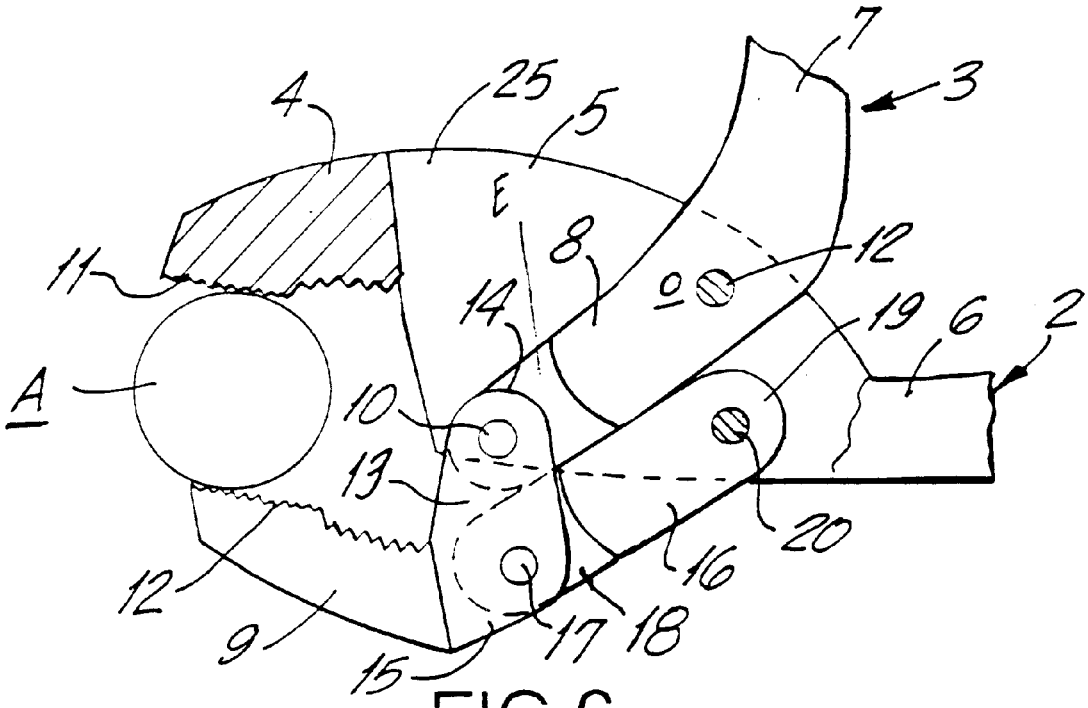
FIG. 6 is a detail partly in section showing jaws in their open position.

The stationary jaw portion 4 has an array of teeth 11 and the movable jaw portion 9 has an array of teeth 12 which face the array of teeth 11 of the stationary jaw portion 4 and are substantially parallel thereto. The movable jaw portion 9 has a tail 13 (FIGS. 4–6) extending substantially at right angles to the array of teeth 12 in the direction of the stationary jaw portion 4. The tail 13 has an inner end 14 and an outer end 15. The outer end 15 is pivotally mounted to a first end 18 of a linkage 16 by means of a pivot pin 17. The linkage 15 has a second end 19 opposite first end 18 which is pivotally mounted to the intermediate portion 5 of the first handle member 2 by means of a pivot pin 20. The inner end 14 of the tail 13 is pivotally mounted to one end E of the intermediate portion 8 of the movable handle member 3 by means of pivot pin 10. The other end O of the intermediate portion 8 of movable handle member 3 is pivotally mounted to the intermediate portion 5 of the first handle member 2 by means of a pivot pin 21 which is spaced from pivot pin 10. A space 25 is formed in the intermediate portion 5 of the first handle member 2 to receive tail 12, linkage 16 and the intermediate portion 8 of the second handle member 3.

Figure 3:
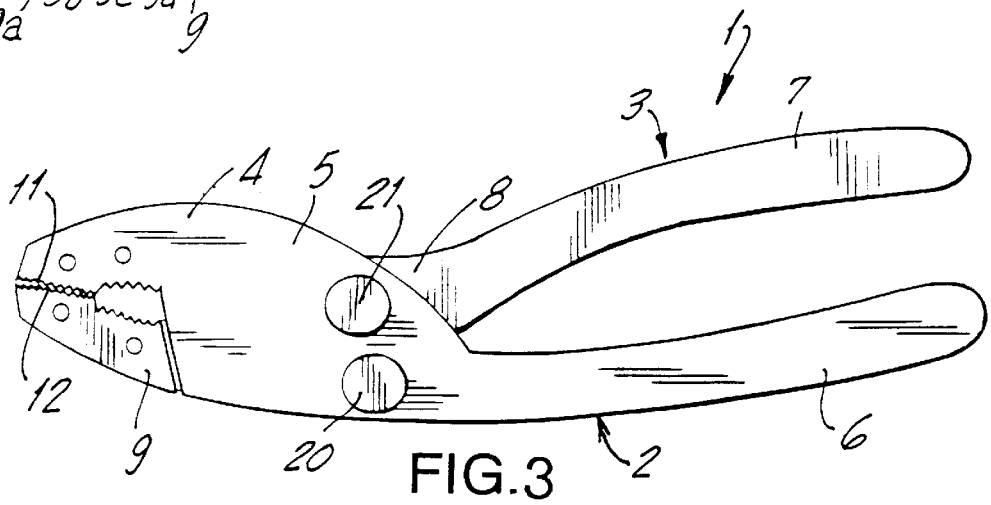
FIG. 3 is a side elevational view showing the tool in its closed position.

It will be seen that when the jaws 4 and 9 are in their closed position (FIGS. 3 and 5), the linkage 16 and intermediate portion 8 of the movable handle assembly 3 are within the space 25 in the first handle member 2. However, when the jaws 4–9 are opened to grasp an article A between them (FIGS. 4 and 6) the hand grip portions 6 and 7 are moved apart so that the second handle member 3 pivots around pivot pin 21 to move its intermediate portion 8 inner end 14 of the tail 13 away from the stationary jaw 4. This in turn pushes the first end 18 of linkage 16 away from the stationary jaw 4 by means of pivot pin 17 which causes the second end 19 of the linkage 16 to pivot around pivot pin 20. In this position parts of both the linkage 16 and the outer end 15 of the tail 13 are moved out of the space 25. It will be seen that in both operations the array of teeth 11–12 maintain the parallel position between them whether they are in the closed position or in the open position.

Figure 2:
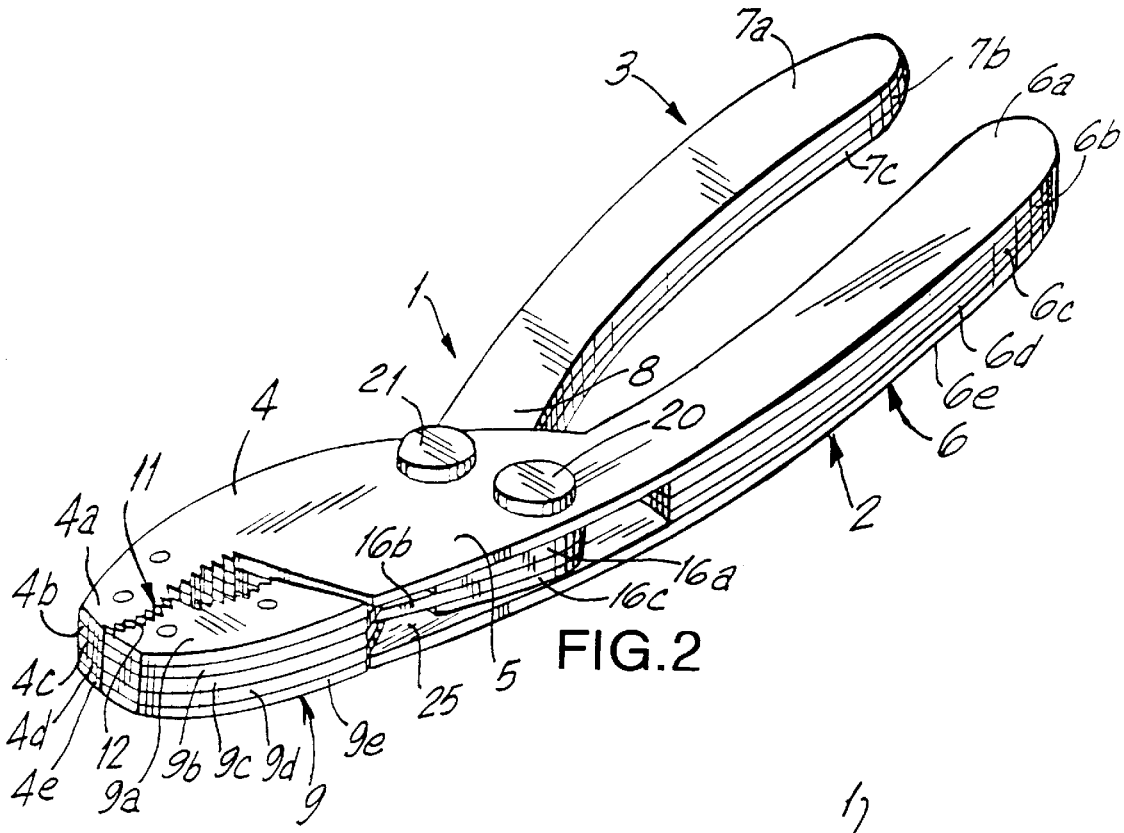
FIG. 2 is a pespective view showing the tool in its closed position.

In the preferred form of the invention, the various components are formed by a plurality of laminations connected together in any desired or well known manner, such as by pins 30 (FIGS. 1 and 2). The first handle member 2 comprises a pair of spaced outer laminates 2*a* and 2*b* comprising integral hand grip portion laminates 6*a* and 6*e,* intermediate laminate portions 5*a* and 5*e* and jaw portion laminates 4*a* and 4*e*. Between hand grips laminates 6*a* and 6*e* are hand grip portion laminates 6*b,* 6*c* and 6*d*.

Between jaw portion laminates 4*a* and 4*e* are provided jaw portion laminates 4*b*, 4*c* and 4*d*. There are no laminates between the intermediate portion laminates 5*a* and 5*e* thereby creating the space 25 between the intermediate portion laminates 5*a* and 5*e*.

The second handle member 3 is comprises of a plurality of hand grip portion laminates 7*a*, 7*b* and 7*c*. These laminates have integral intermediate portion laminates 8*a* 8*b* and 8*c*. The central intermediate portion laminate 8*b* has a forward end 8*d* extending beyond the end of the intermediate portion laminates 8*a* and 8*c*. The linkage 16 is comprised of linkage laminates 16*a* 16*b* and 16*c* with central linkage laminate 16*b* has a front end 16*d* extending beyond the front end of linkage laminates 16*a* and 16*c*. The movable jaw portion 9 of the second handle member 3 comprises laminates 9*a,* 9*b*, 9*c,* 9*d* and 9*e*. Only the movable jaw portion laminates 9*b,* 9*d* and 9*e* have tails 13*b,* 13*d* and 13*e*. The movable jaw portion laminate 9*a* and 9*c* do not have a tail creating a space between laminate 9*d* and laminate 9*b* to accommodate the forward end 16*d* of the linkage 16*b* therebetween.

It will thus be seen that the present invention provides an improved parallel grip plier which is easily assembled, simple to use and inexpensive to manufacture.

As many varied modification of the subject matter of this invention will become apparent to those skilled in art from the detailed description given herein above, it will be understood that the present invention is limited only as provided in the claims appended hereto.

What is claimed is:

1. A plier comprising a first handle member and a second handle member, each of said handle members having a jaw portion, an intermediate portion and a hand grip portion, said second handle member comprises a movable hand grip portion and a movable jaw portion, said first handle member comprises a stationary jaw portion and a stationary hand grip portion, the movable jaw portion and the movable hand grip portion being separate from each other, the moveable jaw portion having a tail pivotally mounted to the intermediate portion of the second handle member, said intermediate portion of the second handle member being pivoted to the intermediate portion of the first handle member, a linkage having one end pivotally attached to the said tail and its other end being pivotally attached to the intermediate portion of the first handle member.

2. A plier as set forth in claim 1, wherein the pivotal points of said intermediate portion s are spaced from each other and the pivot points of the tail are spaced from each other.

3. A plier as set forth in claim 3, wherein said jaw portions each have an array of teeth parallel to each other.

4. A plier as set forth in claim 3 wherein said tail extends from the movable jaw toward the stationary jaw at right angles thereto and has an inner end and an outer end.

5. A plier as set forth in claim 4 wherein the inner end of the tail is pivoted to an end of said intermediate portion.

6. A plier as set forth in claim 5 where in the outer end of the tail is pivoted to one end of said linkage.

7. A plier as set forth in claim 6, wherein the intermediate portion of the first handle member has a space to receive the said tail, linkage and intermediate portion of the second handle member.

8. A plier as set forth in claim 7 wherein said jaw portions and hand grip portions are comprised of laminations, the intermediate portion of the second handle being comprised of laminations, the linkage being comprised of laminations, and the said tail being comprised of laminations.

9. A plier as set forth in claim 8 wherein the intermediate portions of the first handle member is devoid of laminations to form the said space.

* * * * *